US007766270B2

(12) United States Patent
Piepgras

(10) Patent No.: US 7,766,270 B2
(45) Date of Patent: Aug. 3, 2010

(54) TRANSPORTABLE BLANKET ROLLER

(76) Inventor: Douglas D. Piepgras, 10330 Gulden Ave. NW, Maple Lake, Wright, MN (US) 55358

( * ) Notice: Subject to any disclaimer, the term of this patent is extended or adjusted under 35 U.S.C. 154(b) by 96 days.

(21) Appl. No.: 12/167,816

(22) Filed: Jul. 3, 2008

(65) Prior Publication Data

US 2010/0001114 A1 Jan. 7, 2010

(51) Int. Cl.
*B65H 75/30* (2006.01)

(52) U.S. Cl. ..... 242/395; 242/403; 242/404.2; 242/532.6

(58) Field of Classification Search ... 242/532.5–532.6, 242/403, 404, 404.2, 395
See application file for complete search history.

(56) References Cited

U.S. PATENT DOCUMENTS

| | | | | |
|---|---|---|---|---|
| 565,054 | A | 8/1896 | Trembly | |
| 2,811,321 | A | 10/1957 | La Barre | |
| 2,960,279 | A * | 11/1960 | Little | 242/532.6 |
| 3,050,273 | A | 8/1962 | Saunders | |
| 3,091,414 | A | 5/1963 | Patnaude | |
| 3,473,755 | A | 10/1969 | Brown | |
| 3,478,980 | A | 11/1969 | Raasch | |
| 3,913,854 | A | 10/1975 | McClure | |
| 3,946,964 | A * | 3/1976 | Zinser | 242/532.6 |
| 4,179,080 | A | 12/1979 | Patnaude | |
| 4,265,414 | A * | 5/1981 | Spradling | 242/532.6 |
| 4,311,288 | A * | 1/1982 | Galland | 242/532.6 |
| 4,390,141 | A * | 6/1983 | Webster | 242/404.2 |
| 4,592,519 | A * | 6/1986 | Peacock | 242/532.6 |
| 4,699,330 | A | 10/1987 | Barazone | |
| 4,705,229 | A | 11/1987 | Barazone | |
| 4,742,970 | A | 5/1988 | Barazone | |
| 4,930,718 | A | 6/1990 | Lancour et al. | |
| 5,033,690 | A * | 7/1991 | McIver | 242/532.6 |
| 5,350,186 | A | 9/1994 | Hull et al. | |
| 5,385,314 | A | 1/1995 | Hughes | |
| 5,568,900 | A | 10/1996 | Conroy | |
| 6,206,317 | B1 * | 3/2001 | Harvestine | 242/395 |
| 6,241,175 | B1 * | 6/2001 | Nichols | 242/395 |
| 6,634,588 | B1 | 10/2003 | Jackson | |
| 6,860,471 | B2 | 3/2005 | Albritton | |
| 7,017,847 | B2 * | 3/2006 | Treat | 242/395 |

* cited by examiner

*Primary Examiner*—Sang Kim
(74) *Attorney, Agent, or Firm*—Albert W. Watkins

(57) ABSTRACT

A transportable insulated blanket roller has a support, and a riser coupled to and extending vertically from the support. A bearing support is coupled to the riser, and has an insulated blanket retaining rod passing through the bearing support. The rod has a bifurcation defining first and second insulated blanket holding rods that are operative to receive an insulated blanket therebetween. A crank produces a rotary motion in the retaining rod, in turn winding the blanket onto the blanket holding rods. The transportable insulated blanket roller is combined with a land vehicle having a trailer hitch receiver or comparable coupling or support, and an insulated blanket. A method of efficiently using the transportable insulated blanket roller at a construction site is also presented, including using the bifurcated roller to roll an unrolled insulated blanket, and then sliding the insulated blanket off of the bifurcated roller.

13 Claims, 4 Drawing Sheets

TRANSPORTABLE BLANKET ROLLER

BACKGROUND OF THE INVENTION

1. Field of the Invention

This invention pertains generally to the handling of web-type materials in the building and construction industry, and more particularly to a roller designed to be supported upon a vehicle hitch receiver and configured to roll thermal insulation blankets such as are commonly used in colder weather to protect freshly poured concrete and for ground thawing applications, and which may also be used to roll other web building and construction materials that present similar challenges in rolling and storing.

2. Description of the Related Art

During construction of a building, pouring a concrete pad or surface, masonry work, landscaping, excavation, and in other construction projects, there are occasions that may arise in which a roll or web of material will be unwound or otherwise extended to a full longitudinal dimension that may be much greater than either width or thickness of the material. Such is the case when concrete is poured during weather too cold or too hot to facilitate proper curing. Other situations might, for exemplary purposes only, include the placing of large sheets to form temporary shelter during construction in inclement weather, or a myriad of other situations too numerous to separately list or describe herein.

While it is known to incorporate various additives directly into concrete that will improve the curing and setting of the concrete at lower temperatures or higher temperatures, there are still temperature limits within which optimum curing and optimum ultimate strength will be achieved. If weather conditions are forecast to be either too cold or too hot to ensure optimum or sometimes even safe characteristics, or when temperature control may alter the curing speed favorably, a builder may elect to control the environment within which the concrete cures. It is known in the prior art to form a covering over the concrete using thin polyethylene sheeting, and heat, cool or otherwise control the air space between the polyethylene and the concrete. This method has several drawbacks, not the least of which is the relatively soft and fragile nature of the polyethylene, which may tear or come loose from anchors. Further, the plastic sheet has quite low softening and combustion temperatures, so a heater may inadvertently melt or even ignite the sheeting. Tears, separation, melting or combustion will expose the concrete directly to the temperatures that were to be avoided, and can even be the source of fire that could damage not only the concrete but also surrounding construction. In such cases, at a minimum the concrete will be completely lost and will need to be removed, disposed of, and the site prepared once more for a new concrete pour. The need for heaters, air conditioners, or other devices is also undesirable since these devices must also be transported to and left at the job site, where they may be stolen or may fail. In either case, not only will the concrete suffer the undesired fate which the sheeting was to prevent, the shelter above the concrete may in fact exacerbate the problem. For example, if the air space is being cooled on a hot sunny day, failure of the cooling equipment may result in the plastic forming a greenhouse over the concrete, which could lead to temperatures even greater than if the plastic were never used at all.

In contrast to polyethylene sheeting, insulation blankets are stronger and more durable, essentially temperature insensitive, and provide substantial thermal insulation that in many cases may eliminate the need for any supplementary heating or cooling. Instead, the thermal insulation which may for exemplary purposes be formed from webs of insulation, commonly known as concrete curing blankets or insulated blankets, is sufficient to use the average ground temperature and thermal mass of the building material or ground to provide suitable temperature moderation. In extremely cold weather, both the concrete as poured and the ground below will desirably be sufficiently warm that, with sufficient thermal insulation above, concrete will not freeze during cure. Likewise, in extremely hot weather, the thermal blankets will limit concrete to temperatures close to the ground temperature which is generally substantially cooler than air, while also preventing sunlight from undesirably heating and drying the concrete.

Unfortunately, and in spite of the many benefits and advantages of insulated blankets, there remain a number of drawbacks that have heretofore limited the desirability of using them in building and construction projects. One limitation is the average size of an insulated blanket, which in the industry may typically be five and one-half feet wide and range in length from eight to twenty-five feet. This large size is desirable since it reduces the number of seams when in use, thereby also reducing the likelihood that any harm or undesired exposure of the protected area will occur. Unfortunately, the large size also makes an insulated blanket very difficult for one worker to handle or carry if the blanket is extended or even folded.

Similar problems arise during transport of insulated blankets. Even though there may be very few blankets to transport, a separate trailer may be required just to transport the insulated blankets from one location to another. Insulated blankets, owing to their size, are generally too large to be secured in the bed of a pick-up truck, even when folded in the ordinary manner. The insulated blankets are instead often carried onto a trailer and folded to be able to fit the length of the trailer. Even when positioned on the trailer properly, a person will often still have trouble reliably securing the blankets to the trailer with tie-down straps or the like without harming the blankets. This is due to the soft compressible materials that the insulated blankets are made from, and the intrinsically large surface area, combined with low mass, of the insulated blankets. Simply stated, a person must tie down the blankets sufficiently to ensure that no portions of the blankets are free to pop up and catch in the wind while being transported down the road. This must be done without damaging the insulated blankets directly with the securing straps. Once again, this added time loading and securing the blankets limits the number of applications where a builder will even consider using these blankets.

There are a variety of carts that have been provided for deploying or rolling up fence, wire, mesh, pool and ground covers in the prior art. Exemplary of these are U.S. Pat. No 565,054 by Trembly, entitled "Reel carrier;" U.S. Pat. No. 3,050,273 by Saunders, entitled "Roll carrier;" U.S. Pat. No. 3,091,414 by Patnaude, entitled "Pool cover dolly;" U.S. Pat. No. 3,473,755 by Brown, entitled "Automatic laying and retrieving ground cover apparatus;" and U.S. Pat. No. 4,179,080 by Patnaude, entitled "Dolly;" the contents and teachings of each which are incorporated herein by reference. While illustrating potentially useful and beneficial carts, each of these apparatus undesirably require the transport of the relatively large and complex cart to and from location, and the expense of fabrication associated with such a cart. Several also have no provision for use with more than a single web or roll of material.

A few patents are exemplary of reels or dispensers that are coupled to a vehicle through a receiver hitch. These include U.S. Pat. No. 5,350,186 by Hull et al, entitled "Towline reel attachable to a trailer hitch receptacle;" U.S. Pat. No. 5,568, 900 by Conroy, entitled "Receiver hitch spooled wire dispenser;" and U.S. Pat. No. 6,860,471 by Albritton, entitled "Fence dispensing apparatus;" the teachings of each which are incorporated herein by reference. These patents do not provide any apparatus that would be of use in both unrolling and rolling insulated blankets or other like materials used in the building and construction industry.

Additional patents from which teachings are incorporated herein by reference include U.S. Pat. No. 2,811,321 by La Barre, entitled "Truck tarpaulin reel;" U.S. Pat. No. 3,478,980 by Raasch, entitled "Roller for truck cover;" U.S. Pat. No. 3,913,854 by McClure, entitled "Tensioned unrolling device for fabric rolls;" U.S. Pat. No. 4,699,330 by Barazone, entitled "Apparatus for laying paving fabric;" U.S. Pat. No. 4,705,229 by Barazone, entitled "Compact apparatus for laying paving fabric;" U.S. Pat. No. 4,742,970 by Barazone, entitled "Paving fabric stretching mechanism;" U.S. Pat. No. 5,385,314 by Hughes, entitled "Cable reel level wind mechanism;" and U.S. Pat. No. 6,634,588 by Jackson, entitled "Winch rotator for all terrain vehicles;" though these patents may be somewhat less relevant than the aforementioned patents. Webster's New Universal Unabridged Dictionary, Second Edition copyright 1983, is additionally incorporated herein by reference in entirety for the definitions of words and terms used herein.

SUMMARY OF THE INVENTION

Exemplary embodiments of the present invention solve inadequacies of the prior art by providing a readily assembled and disassembled transportable insulated blanket roller, and a method by which insulated blankets may be rolled, bound, stored or transported in the rolled and bound state, and unrolled for use.

In a first manifestation, the invention is, in combination, a land vehicle having a trailer hitch receiver, a transportable insulated blanket roller supported upon the land vehicle and an insulated blanket. The transportable insulated blanket roller has a hitch tube inserted at a hitch tube first end into the trailer hitch receiver. A hitch-riser coupler couples to the hitch tube at a location on the hitch tube generally distal to the hitch tube first end and the trailer hitch receiver. A riser couples to the hitch-riser coupler at a riser first end and extends vertically therefrom to a riser second end. A support-riser coupler couples to the riser adjacent the riser second end. A bearing support couples to the support-riser coupler, and has a bearing tube, bearings, and a rotation controller. A winding handle is provided. An insulated blanket retaining rod is coupled to rotate responsive to movement of the winding handle, passes through the bearing tube and bearings, and has a bifurcation defining as a first bifurcation fork a first material support and as a second bifurcation fork a second material support. The first and second material supports receive the insulated blanket therebetween.

In a second manifestation, the invention is a transportable insulated blanket roller. The transportable insulated blanket roller has a support, and a riser coupled to the support at a riser first end and extending vertically therefrom to a riser second end. A bearing support is coupled to the riser. A crank produces a rotary motion. An insulated blanket retaining rod is coupled to the crank to rotate responsive to rotary motion produced by the crank and has a bifurcation defining a first insulated blanket holding rod and a second insulated blanket holding rod spaced from the first insulated blanket holding rod. The first and second insulated blanket holding rods are operative to receive an insulated blanket therebetween.

In a third manifestation, the invention is a method of efficiently using at least one insulated blanket at a construction site to insulate a mass. According to the method, at least one rolled insulated blanket is stored at a first location. The at least one rolled insulated blanket is transported to a second location. The at least one rolled insulated blanket is slid onto a bifurcated roller. The at least one rolled insulated blanket is unrolled from the bifurcated roller to form at least one unrolled insulated blanket. The at least one unrolled insulated blanket is positioned relative to the mass to thermally insulate the mass at least in part from a surrounding environment. The at least one unrolled insulated blanket is rolled onto the bifurcated roller to thereby restore the at least one unrolled insulated blanket to the at least one rolled insulated blanket. The at least one rolled insulated blanket is slid off of the bifurcated roller. The at least one rolled insulated blanket is transported to the first location.

OBJECTS OF THE INVENTION

A first object of the invention is to alleviate much of the inconvenience associated with rolling up and transporting concrete curing blankets on construction job sites. A second object of the invention is to meet certain design criteria in function and use. Another object of the present invention is to maintain ease of manufacturing, shipping and storage. This will desirably require minimal shop fabrication and minimal parts, to enable shipment to a purchaser in a disassembled state, while initial assembly requires only common tools and no significant assembly skills. As a corollary thereto, it is an object of the present invention after initial assembly that the apparatus may be assembled and disassembled rapidly without the use of any tools, or less preferably with only minimal or common tools, while achieving a correct length so that the apparatus may lay flat in the bed of a pickup truck. A further object of the invention is to easily support the apparatus within a vehicle hitch receiver or alternatively upon fabricated support which might readily be otherwise provided. Yet another object of the present invention is to allow a user to stand comfortably with the operating handle at a height that is easy to use, and turned at an angle relative to the back of a pick up truck such that the main support tube and blanket being rolled are away from the vehicle sufficiently to minimize the chance of damaging contact therebetween.

BRIEF DESCRIPTION OF THE DRAWINGS

The foregoing and other objects, advantages, and novel features of the present invention can be understood and appreciated by reference to the following detailed description of the invention, taken in conjunction with the accompanying drawings, in which.

DESCRIPTION OF THE PREFERRED EMBODIMENT

Figure 1:
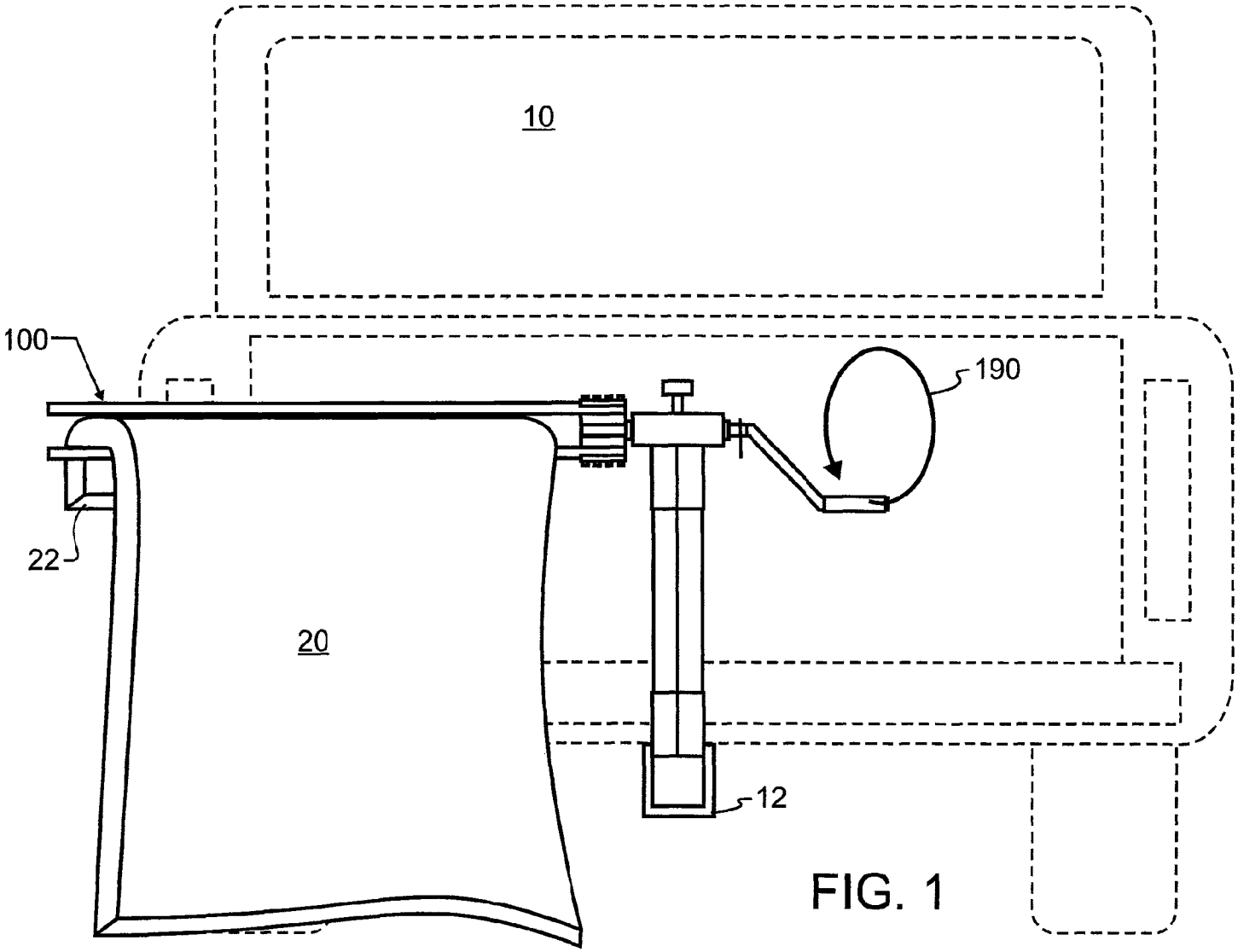
FIG. 1 illustrates a preferred embodiment transportable blanket roller designed in accord with the teachings of the present invention, in further combination with a land vehicle and an insulated blanket.

In one preferred embodiment of the invention illustrated in FIG. 1, the invention is in combination, a land vehicle 10 having a trailer hitch receiver 12, a transportable insulated blanket roller 100 supported upon land vehicle 10 by insertion within trailer hitch receiver 12, and an insulated blanket 20. This preferred combination best illustrates both the mobility of the present invention, and the ease by which benefit may be garnered. As may be apparent, to use transportable insulated blanket roller 100, an insulated blanket 20 is passed so that a leading edge 22 thereof passes between material tubes 162, 164. Only a small leading edge 22 is required, preferably sufficient to ensure that material tubes 162, 164 will capture insulated blanket 20 when handle 180 is rotated in the direction illustrated by arrow 190. Handle 180 will be rotated until insulated blanket 20 is entirely wound about material tubes 162, 164. A band of flaccid material such as a strap, cord, cinch strap, belt, or any other suitable circumferential fastener will then be used to retain insulated blanket 20 in the roll form. Insulated blanket 20 may then be slid away from handle 180 to slide off of material tubes 162, 164, and so may readily be removed completely therefrom. At this point, insulated blanket 20 is ready for transport to or from a construction site, or for storage. Because insulated blanket 20 has been rolled and circumferentially fastened, it takes up much less space in a transport vehicle, is not nearly as prone to being caught in the wind, and is much more easily carried by a single person. Likewise, a rolled insulated blanket 20 may optionally be slid onto material tubes 162, 164 and unrolled therefrom, such that a single person may use transportable insulated blanket roller 100 to not only roll up an insulated blanket 20, but also to place insulated blanket 20 adjacent to a mass or object to be insulated or sheltered. This assists with a preferred method of placing curing blankets over flat concrete pours, by rolling the blankets 20 out first and then lowering them to cover the area, without dragging them across the uncured surface.

Figure 2:
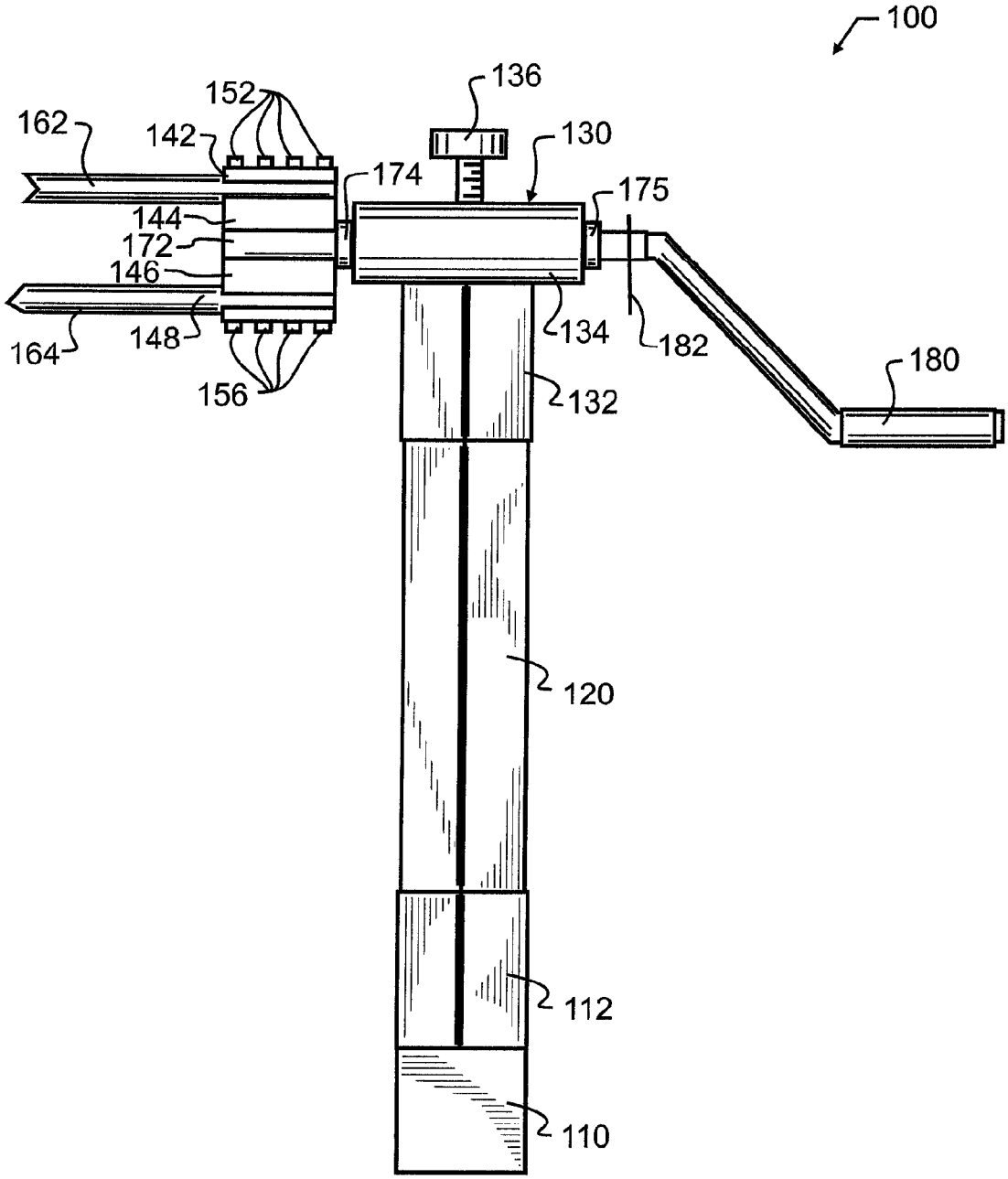
FIG. 2 illustrates the preferred embodiment transportable blanket roller of FIG. 1 from a much closer view, and without land vehicle or insulated blanket, from rear elevation view.
Figure 3:
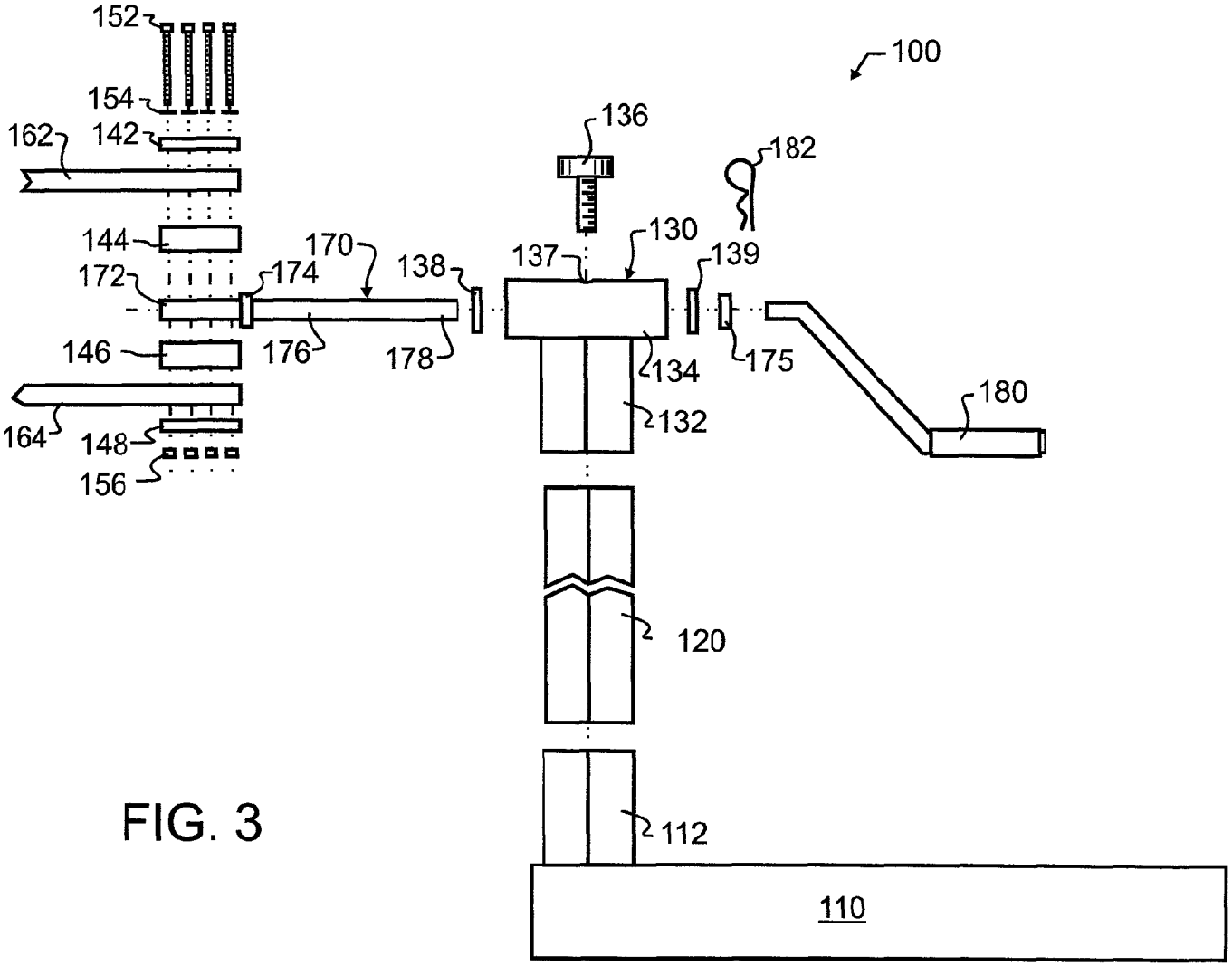
FIG. 3 illustrates the preferred embodiment transportable blanket roller of FIG. 1 by exploded view.
Figure 4:
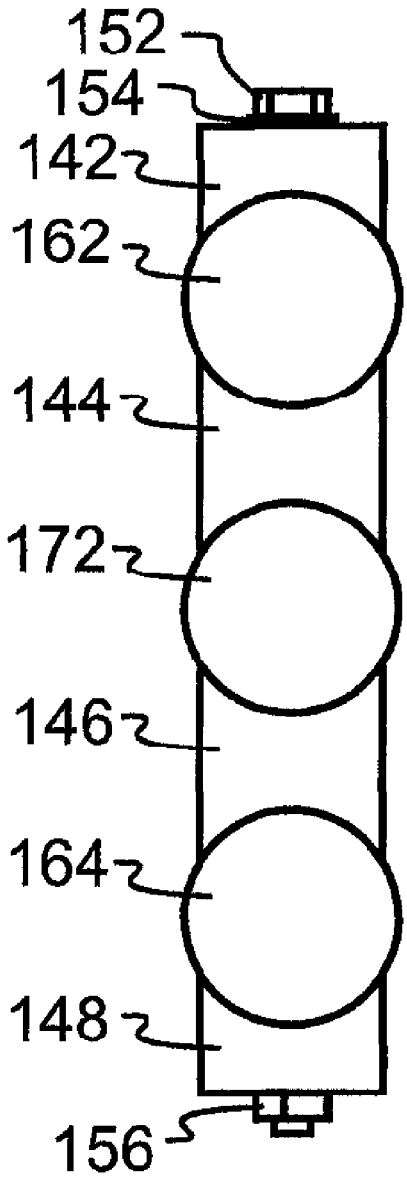
FIG. 4 illustrates the combination material tubes, bearing tube, and various plates by enlarged side elevation view, and with other background components removed to best illustrate the components of the foreground.

FIGS. 2-4 illustrate a preferred embodiment transportable insulated blanket roller 100 in more detail. As may be seen therein, a hitch tube 110 is preferably configured to be inserted into a standard prior art trailer hitch receiver 12. As is known in the art, inserts into these types of receivers are commonly pinned or otherwise suitably coupled, and similar provision may optionally be understood for hitch tube 110. A hitch-riser coupler 112 is provided at a location on hitch tube 110 generally distal to where hitch tube 110 will couple with trailer hitch receiver 12. In the preferred embodiment, hitch-riser coupler 112 is offset about a vertical axis by approximately 45 degrees from having the faces of hitch-riser coupler 112 align with the faces of hitch tube 110. The particular angle of offset, or lack thereof, is not critical to the invention, but it will be apparent from the figures that it is desirable to maintain clearance between each of the components even when insulated blanket 20 is completely rolled, and during the rolling thereof. This angle of offset favors that, while providing easier access to the open end of transportable insulated blanket roller 100. A riser 120 is coupled to hitch-riser coupler 112 and extends vertically therefrom by any suitable amount to a support-riser coupler 132, which is preferably coupled to riser 120. In the preferred embodiment, riser 120 is of slightly smaller outside diameter (O.D.) than the inside diameter (I.D.) of the couplers 112, 132. This permits gravity to be used as the sole coupling force retaining these components together, though it will be apparent that the fittings may incorporate other coupling forces, such as friction or various fasteners and hardware which are well known in the coupling arts. Support riser 132 forms one part of bearing support 130. Bearing support 130 additionally includes a bearing tube 134, bearings 138, 139 which are contemplated herein to be bushings or ordinary ball bearings that are located inside of and at each end of bearing tube 134, and a threaded knob 136 serving as a rotation controller by being selectively tighten into or threaded out of threaded hole 137 to engage and lock rotation of center hub 176.

An insulated blanket retaining rod 170 is coupled to handle 180 through a cotterpin 182 passing through both handle 180 and handle end 178 of retaining rod 170 to rotate responsive to movement of winding handle 180. Retaining rod 170 passes through bearing tube 130 and bearings 138, 139, and has a bifurcation distal to winding handle 180. The bifurcation defines as a first bifurcation fork a first material support 162 and as a second bifurcation fork a second material support 164. The first and second material supports 162, 164 will receive the insulated blanket 20 therebetween as already discussed herein above during use. Insulated blanket retaining rod 170 further has a center hub 176 terminating at first center hub end 178 with a handle receiver and having a removable stop 175 adjacent bearing 139 and handle 180. A fixed stop 174 is adjacent bearing 138, and distal to handle 180 about bearing support 130. Center hub 176 passes through bearing support 130 between fixed stop 174 and removable stop 175. In one conceived embodiment, stop 175 may be combined unitarily or integrated with bearing 139 into a single component, as is known in the bearing art. The same may be done with fixed stop 174 and bearing 138. In a further alternative, fixed stop 174 and bearing 138 may not need to be fixed, and may be removable and/or integrated into a single component.

The bifurcation is best illustrated in FIG. 4, which is a view of transportable insulated blanket roller 100 looking from first and second material supports 162, 164 towards handle 180. As is apparent therefrom and in FIG. 3, a top plate 142 is placed adjacent a first end of material support 162, while a bottom plate is placed adjacent a first end of material support 164. Captured in between is a middle plate 144 adjacent the first end of material support 162. In combination with top plate 142, middle plate 144 surrounds and retains material support 162 in position. A second middle plate 146 is adjacent the first end of material support 164, and in combination with bottom plate 148 surrounds and retains material support 164 in position. Middle plates 144, 146 additionally surrounding and retain end 172 in place. At least one fastener, which may take many forms but for illustrative purposes only and not limiting thereto comprises a plurality of bolts 152, washers 154 and nuts 156, fixes top and bottom plates 142, 148, material supports 162, 164, center hub end 172, and middle plates 144, 146 together. Winding handle 180 in the preferred embodiment may readily be detached from center hub end 178 through removal of a fastener, in the preferred embodiment cotterpin 182.

As may be apparent from the foregoing description, the materials used in the implementation of the present invention are not critical to the operation thereof beyond the ordinary and well-known requirements for compositions and coatings as would be reasonably required for the present application. The use of solid or tubular components is also optional for many of the illustrated components, the exceptions which will be obvious such as bearing support 130, though tubular construction will in most cases provide adequate strength and less weight and materials cost.

In one conceived alternative embodiment, it is further contemplated herein that material supports 162, 164 and/or hitch tube 110 may be telescopic or the like, to provide material supports that are longitudinally extensible and collapsible to accommodate both vehicles of differing dimensions, when transportable insulated blanket roller 100 is disassembled and transported, and to permit adaptation to a variety of widths of insulated blankets 20. With appropriate selection of which components to produce as telescoping components, it is further contemplated herein that transportable insulated blanket roller 100 may even be carried about in relatively compact carry bag.

In another conceived alternative embodiment, winding handle 180 may be any of a variety of known cranks, and may include diverse devices including motors and other apparatus that are capable of producing a rotary motion.

In a further conceived alternative embodiment, other stationary or mobile devices may be used to support transportable insulated blanket roller 100 for intended use. This may easily be achieved by using the receiver hitch commonly found on pickup trucks for other applications, but alternatively, this may be achieved by simply fasting a square tube of like construction to hitch-riser coupler 112 to any object adequate to support the weight of transportable insulated blanket roller 100 and any blanket 20 and forces applied by a user. For exemplary purposes only, and not limiting thereto, a square tube might be fastened to the tongue or to the side of a trailer.

While the foregoing details what is felt to be the preferred embodiment of the invention, no material limitations to the scope of the claimed invention are intended. Further, features and design alternatives that would be obvious to one of ordinary skill in the art are considered to be incorporated herein. As but one example, while the preferred and alternative embodiments described herein above are specifically optimized for insulated blankets 20, those skilled in the art will recognize from a review of the foregoing that changes in dimension and proportion will permit the present invention to be optimized for use with other types of webbing or other sheet materials. The scope of the invention is set forth and particularly described in the claims herein below.

I claim:

1. In combination, a land vehicle having a trailer hitch receiver, a transportable insulated blanket roller supported upon said land vehicle and an insulated blanket, said transportable insulated blanket roller comprising:

a hitch tube inserted at a hitch tube first end into said trailer hitch receiver;

a hitch-riser coupler coupling to said hitch tube at a location on said hitch tube generally distal to said hitch tube first end and said trailer hitch receiver;

a riser coupled to said hitch-riser coupler at a riser first end and extending vertically therefrom to a riser second end;

a support-riser coupler coupled to said riser adjacent said riser second end;

a bearing support coupled to said support-riser coupler, and having a bearing tube, bearings, and a rotation controller;

a winding handle; and an insulated blanket retaining rod coupled to rotate responsive to movement of said winding handle, passing through said bearing tube and said bearings, and having a bifurcation defining as a first bifurcation fork a first material support and as a second bifurcation fork a second material support, said first and second material supports receiving said insulated blanket therebetween;

wherein said insulated blanket retaining rod further comprises a center hub terminating at a first center hub end with a handle receiver and has a removable stop adjacent said bearing support and said handle receiver, a fixed stop adjacent said bearing support and distal to said handle receiver, and a center that passes through said bearing support between said fixed stop and said removable stop, a top plate adjacent a first end of said first material support, a bottom plate adjacent a first end of said second material support, a first middle plate adjacent said first end of said first material support and in combination with said top plate surrounding and retaining said first material support; a second middle plate adjacent said first end of said second material support and in combination with said bottom plate surrounding and retaining said second material support, said first and second middle plates surrounding and retaining said center hub, and at least one fastener fixing said top and bottom plates, first and second material supports, said center hub, and said first and second middle plates together.

2. The combination land vehicle, transportable insulated blanket roller and insulated blanket of claim 1, wherein said transportable insulated blanket roller is supported upon said land vehicle within said trailer hitch receiver.

3. The combination land vehicle, transportable insulated blanket roller and insulated blanket of claim 1, wherein said hitch-riser coupler is detachably coupled to said hitch tube.

4. The combination land vehicle, transportable insulated blanket roller and insulated blanket of claim 1, wherein said insulated blanket retaining rod terminates at a rod first end at said winding handle, and said bifurcation is distal to said winding handle.

5. The combination land vehicle, transportable insulated blanket roller and insulated blanket of claim 1, wherein said rotation controller further comprises a threaded knob to tighten in a threaded hole to engage and lock rotation of said center hub.

6. The combination land vehicle, transportable insulated blanket roller and insulated blanket of claim 1, wherein said winding handle is detachable from said center hub through a removable fastener.

7. The combination land vehicle, transportable insulated blanket roller and insulated blanket of claim 1, wherein at least one of said hitch tube and said first and second material supports are longitudinally extensible and collapsible.

8. A transportable insulated blanket roller, said transportable insulated blanket roller comprising:

a support;

a riser coupled to said support at a riser first end and extending vertically therefrom to a riser second end;

a bearing support coupled to said riser;

a crank producing a rotary motion; and an insulated blanket retaining rod coupled to said crank to rotate responsive to rotary motion produced by said crank and having a bifurcation defining a first insulated blanket holding rod and a second insulated blanket holding rod spaced from said first insulated blanket holding rod, said first and second insulated blanket holding rods operative to receive an insulated blanket therebetween;

wherein said insulated blanket retaining rod further comprises a center hub terminating at a first center hub end with a handle receiver and having a removable stop adjacent said bearing support and said handle receiver, a fixed stop adjacent said bearing support and distal to said handle receiver, and a center that passes through said bearing support between said fixed stop and said removable stop, said first and second insulated blanket holding rods, a top plate adjacent a first end of said first insulated blanket holding rod, a bottom plate adjacent a first end of said second insulated blanket holding rod, a first middle plate adjacent said first end of said first insulated blanket holding rod and in combination with said top plate surrounding and retaining said first insulated blanket holding rod; a second middle plate adjacent said first end of said second insulated blanket holding rod and in combination with said bottom plate surrounding and retaining said second insulated blanket holding rod, said first and second middle plates surrounding and retaining said center hub, and at least one fastener fixing said top and bottom plates, said first and second insulated blanket holding rod, said center hub, and said first and second middle plates together.

9. The transportable insulated blanket roller of claim 8, further comprising a hitch tube operative for coupling at a hitch tube first end with a land vehicle trailer hitch receiver, and said support further comprising a hitch-riser coupling said riser to said hitch tube at a location on said hitch tube generally distal to said hitch tube first end.

10. The transportable insulated blanket roller of claim 8, wherein said riser is detachably coupled to said support.

11. The transportable insulated blanket roller of claim 8, wherein said bearing support is coupled to said riser and further comprises a bearing tube, bearings, and a rotation controller.

12. The transportable insulated blanket roller of claim 11, wherein said rotation controller further comprises a threaded knob rotatable to tighten in a threaded hole in said bearing support to engage with and prevent rotation of said insulated blanket retaining rod.

13. The transportable insulated blanket roller of claim 8, wherein said insulated blanket retaining rod terminates at a rod first end at said winding handle, passes through said bearing tube and said bearings, and said first insulated blanket holding rod and said second insulated blanket holding rod are distal to said winding handle and terminate said insulated blanket retaining rod at a rod second end distal to said rod first end.

* * * * *